US005239316A

United States Patent [19]

Demarchi et al.

[11] Patent Number: 5,239,316

[45] Date of Patent: Aug. 24, 1993

[54] HEAD TEND MEDIA AND SYSTEM FOR AN INK JET PRINTER

[75] Inventors: Michael E. Demarchi, Palmadale; Daniel S. Redford, Woodland Hills; A. Justine Worley, Chino Hills, all of Calif.

[73] Assignee: Dataproducts Corporation, Woodland Hills, Calif.

[21] Appl. No.: 923,003

[22] Filed: Jul. 30, 1992

Related U.S. Application Data

[63] Continuation of Ser. No. 793,247, Nov. 12, 1991, abandoned, which is a continuation of Ser. No. 544,115, Jun. 21, 1990, abandoned, which is a continuation of Ser. No. 433,696, Nov. 9, 1989, abandoned.

[51] Int. Cl.[5] ..... B41J 2/165

[52] U.S. Cl. ..... 346/140 R; 346/1.1

[58] Field of Search ..... 346/1.1, 140 R

[56] References Cited

U.S. PATENT DOCUMENTS

| | | | |
|---|---|---|---|
| 4,112,435 | 9/1978 | Kattner . | |
| 4,223,322 | 9/1980 | Raamsdonk . | |
| 4,241,357 | 12/1980 | Anestos . | |
| 4,340,897 | 7/1982 | Miller . | |
| 4,367,479 | 1/1983 | Bower . | |
| 4,369,456 | 1/1983 | Cruz-Uribe | 346/140 R |
| 4,389,657 | 6/1983 | McMahon . | |
| 4,410,900 | 10/1983 | Terasawa . | |
| 4,479,136 | 10/1984 | Lewis . | |
| 4,517,577 | 5/1985 | Miranda . | |
| 4,533,927 | 8/1985 | Iwagami . | |
| 4,543,589 | 9/1985 | Terasawa . | |
| 4,567,494 | 1/1986 | Taylor . | |
| 4,571,601 | 2/1986 | Teshima . | |
| 4,577,203 | 3/1986 | Kawamura | 346/140 PD |
| 4,591,870 | 5/1986 | Braun . | |
| 4,591,873 | 5/1986 | McCann . | |
| 4,641,154 | 2/1987 | Mikalsen . | |
| 4,658,274 | 4/1987 | DeYoung . | |
| 4,739,340 | 4/1988 | Terasawa . | |
| 4,791,437 | 12/1988 | Accattino . | |
| 4,800,403 | 1/1989 | Accattino . | |
| 4,829,318 | 5/1989 | Racicot . | |
| 4,855,764 | 8/1989 | Humbs et al. | 346/140 R |
| 4,947,190 | 8/1990 | Mizusawa | 346/140 R |

FOREIGN PATENT DOCUMENTS

| | | |
|---|---|---|
| 1426930 | 9/1981 | United Kingdom . |
| 2218049 | 11/1989 | United Kingdom . |

*Primary Examiner*—George H. Miller, Jr.
*Attorney, Agent, or Firm*—Spensley Horn Jubas & Lubitz

[57] ABSTRACT

A head tending media for cleaning the print head of an ink jet printer. The head tend media having a portion of absorbent material attached to a backing material and being dimensioned to be fed through the normal print media feed mechanism of the printer. The absorbent material being positioned such that it is brought into contact with, and wipes the print head as the head tending media is advanced through the printer.

24 Claims, 4 Drawing Sheets

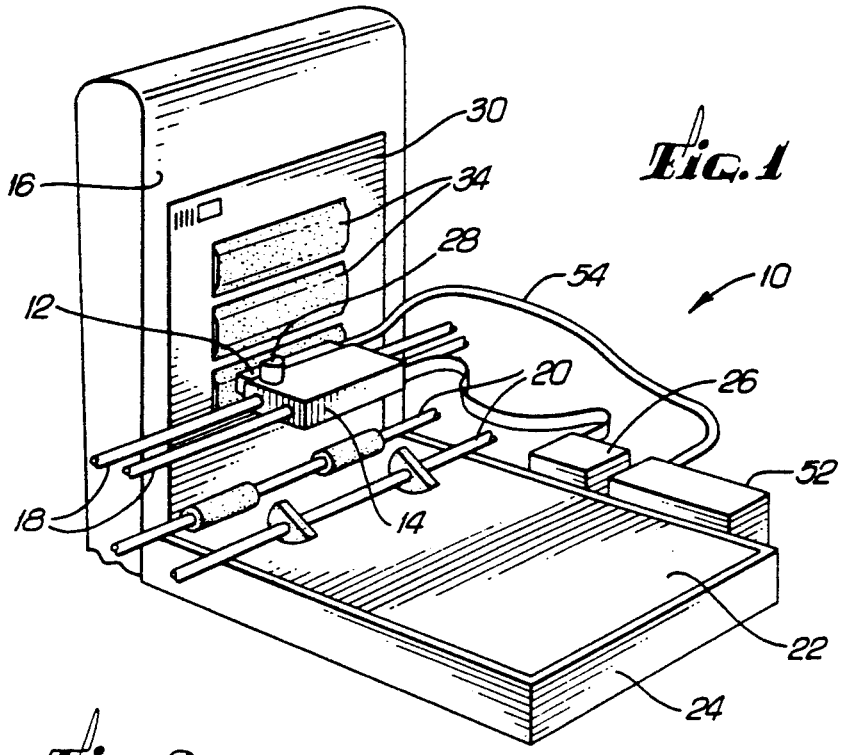
Fig. 1
Fig. 2
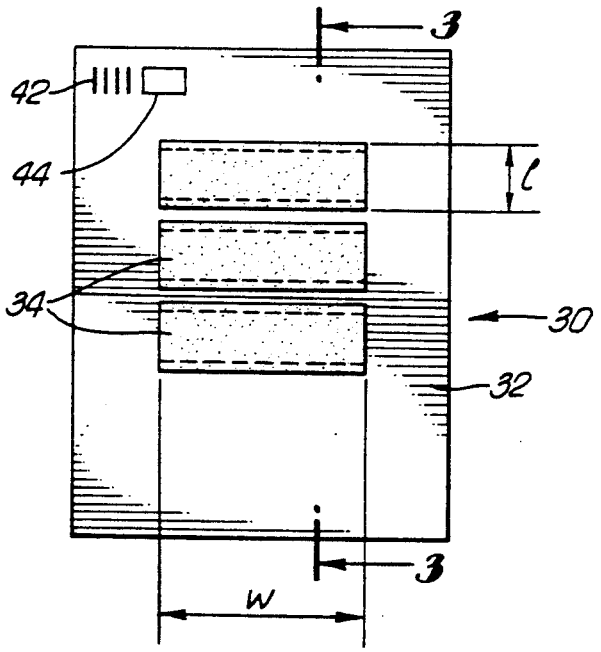
Fig. 3
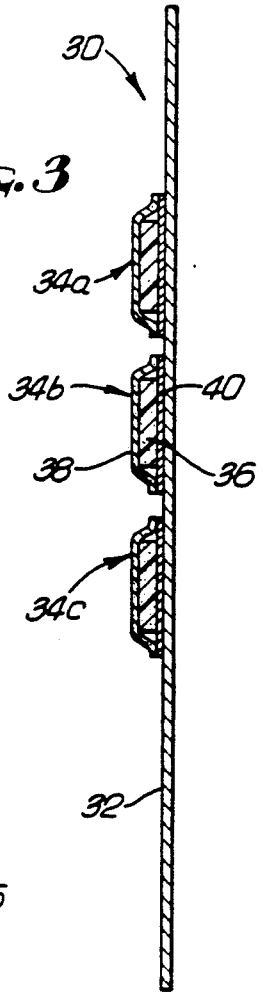
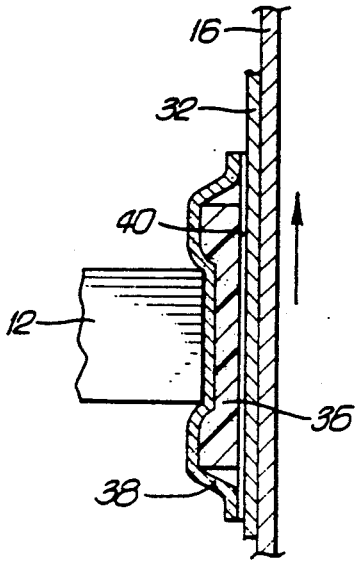
Fig. 4

INITIATE PURGE OPERATION
RETRIEVE MEDIA FROM TRAY
ADVANCE MEDIA AND LOCATE TOP OF FORM
SCAN MEDIA TO LOCATE EDGES
IS MEDIA HEAD TEND MEDIA ?
NO
EJECT MEDIA
PROMPT OPERATOR TO LOAD HEAD TEND MEDIA
YES
HAS HEAD TEND MEDIA BEEN USED IN PRIOR PURGE ?
YES
NO
MOVE PRINT HEAD TO CENTER OF SECOND STRIP
ACTIVATE PURGE PUMP
ADVANCE MEDIA TO WIPE PRINT HEAD
EJECT MEDIA

HEAD TEND MEDIA AND SYSTEM FOR AN INK JET PRINTER

This is a continuation of application Ser. No. 793,247 filed on Nov. 12, 1991, now abandoned, which is a continuation application of application Ser. No. 544,115, filed on Jun. 21, 1990, now abandoned, which is a continuation application of application Ser. No. 433,696, filed Nov. 9, 1989, abandoned.

BACKGROUND OF THE INVENTION

1. Field of the Invention

The present invention relates to ink jet printers, and particularly to a head tend media and system for performing head tend operations such as cleaning or purging the print head on an ink jet printer.

2. Description of Related Art

Typical ink jet printers include a print head which is provided with a plurality of orifices. As the print head moves back and forth over the surface of a print media, ink is expelled through the orifices, or jets, and onto the print media at appropriate intervals to print the desired images, such as characters or graphics. Proper operation of such a printer depends on a uniform and predictable flow of ink through the orifices. Otherwise, the character or graphic being printed may have gaps, skips, or other flaws in areas printed by a faulty orifice.

One cause of faulty orifice operation is the presence of contaminants within the orifice, the ink supply channel leading to the orifice, or on the face of the print head which restrict or obstruct the flow of ink through the orifice. Accordingly, to ensure reliable operation of ink jet printers, it is necessary to keep the face of the print head, the orifices, and the supply channels free of paper dust, stray ink droplets, or other extraneous and undesirable material.

Bubbles within the ink supply channels can also result in restricted or intermittent ink flow through the orifices. Therefore, occasionally it may be desirable to purge ink from the print head in order to prime the orifices and eliminate an bubbles which may be present in the ink supply channel. Purging can also be used to expel old or unwanted ink, or other debris from the supply channels and orifices. However, during a purge operation, it is important to collect the expelled ink to prevent it from collecting on the face of the print head or on other parts of the printer.

Similarly, in solid ink printers, when the print head is being warmed up to operating temperature, ink may be discharged from the head as a result of natural expansion. In order to prevent contamination resulting from discharged ink collecting on the print head or other parts of the printer, any discharged ink should be quickly collected and removed from the printer.

Otherwise, if ink is allowed to collect, it may come into contact with the print media producing smudges or other undesirable marks. Further, if the ink is allowed to solidify within the printer, the solidified ink may break off producing particles of solidified ink which can plug an orifice, jam moving parts of the printer, or impede performance of the printer in some other fashion.

To alleviate the problems associated with contamination and ink build up on print heads several head tend devices and systems have been developed. For example, a variety of mechanisms for mechanically wiping print heads are available. A number of these wiping systems use a nonabsorbent wiper, such as a rubber disc or a steel knife edge, which is wiped across the face of the print head to remove accumulated dirt or ink. However, because the wiping element is nonabsorbent, these types of systems are not adequate for collecting and removing the quantities of ink which may be released during purge and warm up operations. Further, the nonabsorbent wiping element has only limited cleaning capabilities.

Other head tend systems have used absorbent wiping elements. Typically such systems include a spool of absorbent ribbon or tape which is moved across the surface of the print head. However, a printer using such a system must be provided with a drive system for moving the tape and maintaining proper tape tension and position. As a result of the additional moving parts necessary for the drive system, the cost, reliability, and size of the printer are adversely affected. Further, because the wiping media is typically stored on spools, or within cartridges, the wiping media is typically relatively small and thin. As a result, the amount of ink which can be absorbed by the small, thin wiping media is inherently limited.

Another head cleaning system utilizes a cleaning card and a card guide. The cleaning card has a solvent saturated foam strip attached near its bottom edge. The card guide is attached to the print head and is adapted to receive the card. The card guide is positioned such that as the card is manually inserted therein, the foam strip is pressed against the surface of the print head releasing some of the solvent and wiping the head. A drainage system is provided to drain the released solvent from the print head.

However, because the foam strip is relatively small and because it is saturated with solvent, its absorbance capacity is limited. Further, the card guide and the solvent drainage system require the presence of additional hardware within the printer. As with the systems described above, this additional hardware adds to the cost, size, and weight of the printer and may adversely affect the reliability and operation of the printer.

SUMMARY OF THE INVENTION

Accordingly, it is an object of the present invention to provide an improved head tend media and system for the print head of an ink jet printer.

A further object of the invention is to provide a head tend media and system which reduces the necessity for hardware dedicated to feeding and manipulating the head tend media.

Another object of the invention is to provide a head tend media which is capable of absorbing and removing unwanted ink from the printer.

In accordance with these and other objects, the present invention comprises a head tend media having a backing member dimensioned to be fed through the print media feed mechanism of a printer and a portion of absorbent material positioned on the backing member to contact the face of the print head as the media is fed through the printer.

Other objects and aspects of the invention will become apparent to those skilled in the art from the detailed description of the illustrated embodiment which is presented by way of example and not as a limitation of the present invention.

BRIEF DESCRIPTION OF THE DRAWINGS

FIG. 1 shows a partially cutaway view of a printer incorporating a preferred embodiment of the head tend media and system of the present invention.

FIG. 2 is a front view of a preferred embodiment of the head tend media of the present invention.

FIG. 3 is a cross sectional view of the head tend media taken along line 3—3 in FIG. 2.

FIG. 4 is a cross sectional view showing the relation between the print head, the vacuum belt, and a preferred embodiment of the head tend media of the present invention.

DESCRIPTION OF THE ILLUSTRATED EMBODIMENT

Figure 5:
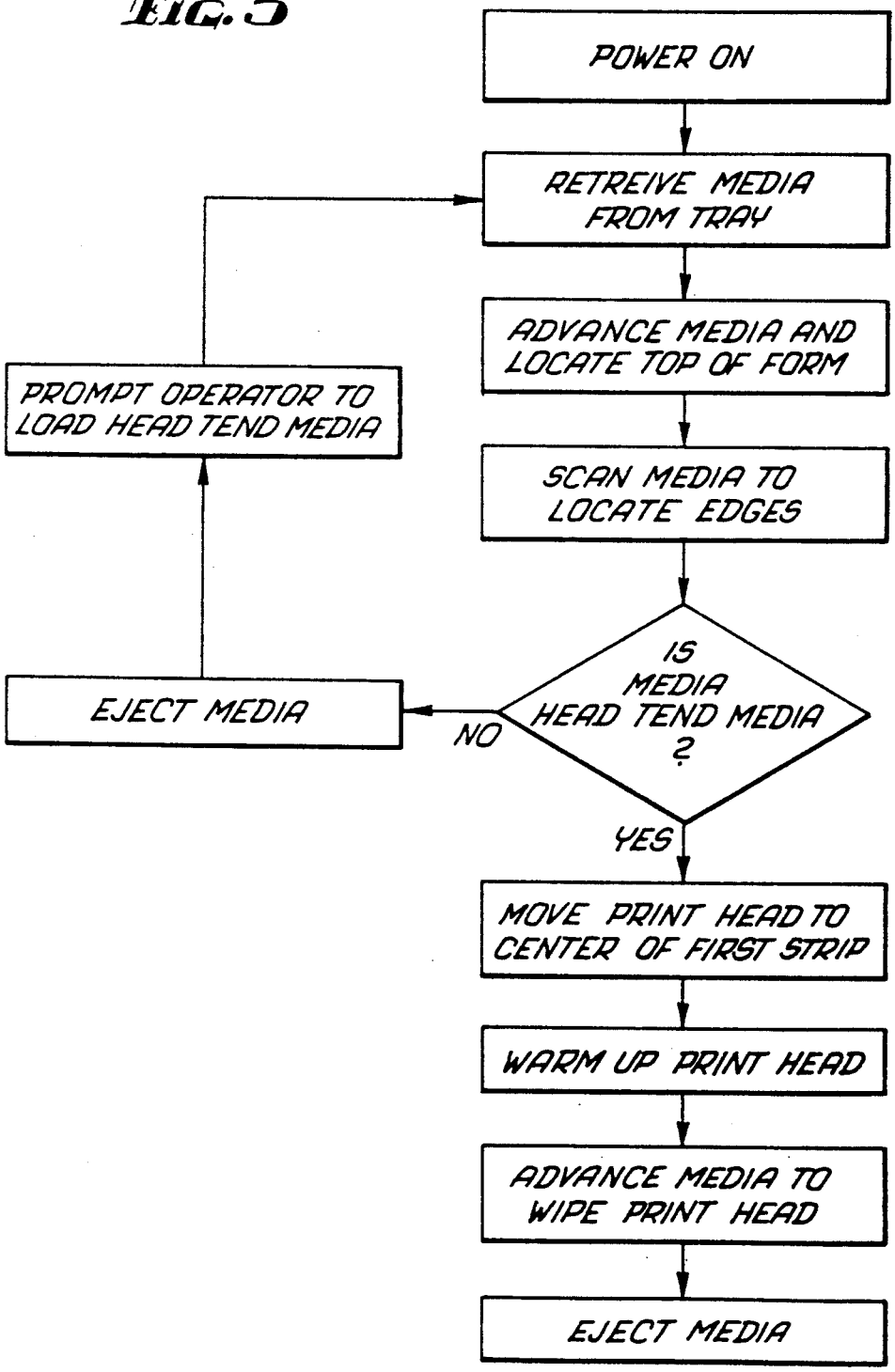
FIG. 5 is a block diagram of a preferred warm up operation utilizing the head tend media illustrated in FIGS. 3 and 4.

A printer with a head tend media and system in accordance with a preferred embodiment of the present invention is indicated in FIG. 1 as reference numeral 10. The printer 10 is provided with a print head 12 mounted on a carriage 14. The carriage 14 is positioned in front of vacuum belt 16 and is laterally movable along guide rails 18.

During normal printing operations, rollers 20 remove one sheet of print media 22 at a time from tray 24 and feed the print media 22 to the vacuum belt 16. Controller 26 controls movement of the vacuum belt 16 to advance the print media 22 past the print head 12, movement of the carriage 14 to move the print head 12 laterally across the surface of print media 22, and activation of the print head 12 to release ink onto the print media 22 at the intervals necessary to print desired text or graphics.

A sensor 28 is mounted on the carriage in a fixed position relative to the print head 12. The sensor 28 is one of a variety of sensors known to those skilled in the art and is capable of detecting the presence or absence of print media 22. In this manner, the controller 26 can monitor the sensor 28 to accurately determine the top of form as the vacuum belt 16 advances the print media 22 and the left and right edges of the form as the carriage 14 traverses the print media 22.

Prior to performing a head tend operation, the head tend media 30 is placed in the tray 24. During the head tend operation, the printer's normal print media feed mechanism is used to feed the head tend media. That is, rollers 20 extract the head tend media 30 from the tray 24 and feed the head tend media 30 to the vacuum belt 16. The head tend media 30 is brought into contact with the print head 12 by advancement of the vacuum belt 16.

As seen in FIG. 2, the head tend media comprises a backing member 32 to which absorbent material 34 is attached. The backing member 32 is dimensioned to fit within the print media storage tray 24 and be fed through the normal feed path of the printer 10. Preferably, the backing member 32 has the same general dimensions as the print media 22. The backing member 32 must be flexible enough to negotiate the bends in the media feed path and strong enough to support the absorbent material 34. Although any material meeting these specifications may be used for the backing member, the backing member in the illustrated embodiment is 20 lb. high speed copier paper. If desired, it is possible to print directions instructing the operator how to us the head tend media directly on the backing member 32.

The absorbent material 34 can be any material which absorbs ink and is sturdy enough to withstand contact with the print head 12 and movement through the feed path of the printer 10. Preferably, the absorbent material 34 is as contaminant free as possible so that it does not deposit contaminants either on the print head 12 or in the printer 10.

As best seen in FIG. 3, the absorbent material 34 of the illustrated embodiment has a layer of foam material 36 overlaid with a layer of absorbent fabric 38. In this manner, a wick-like effect is created by the more absorbent layer of foam material 36 which pulls ink from the absorbent fabric layer 38 and away from the print head 12. A number of materials suitable for the absorbent material are available and can be readily recognized by those skilled in the art. In the illustrated embodiment, the layer of foam material 36 is formed of polyurethane foam available from Wm. T. Burnett & Co. as type S82S and the absorbent fabric layer 38 is clean room lint free wipe available from DuPont under the name SONTARA.

The foam material 36 is attached to the backing member 32 with a layer of adhesive 40. The adhesive 40 extends beyond the boundaries of the foam material 36 to attach the fabric layer 38 to the backing material 32. In the preferred embodiment, there is no adhesive between the fabric layer 38 and the foam material 36 to inhibit the free flow of ink from the fabric layer 38 to the foam material 36. Although a variety of adhesives are suitable for attaching the absorbent material 34 to the backing layer 32, in the illustrated embodiment a pressure sensitive adhesive available under the name ADCHEM 728 acrylic is used.

In order for the head tend media 30 to efficiently clean and wipe the print head 12 and absorb excess ink, it is desireable for the absorbent material 34 to be brought into intimate contact with the print head 12. As illustrated in FIG. 4, this can be accomplished by choosing the thickness of the head tend media 30 such that, in the area of the absorbent material 34, it is slightly thicker than the gap between the print head 12 and the vacuum belt 16, or print media support mechanism. In this manner, the absorbent material 34 is compressed as it is advanced past the print head 12. Thus, the elastic properties of the absorbent material press the surface of the absorbent material into firm, intimate engagement with the print head.

Although the actual thickness of the absorbent material 34 may vary substantially depending on the type of material used and the physical configuration of the print head 12 and printer 10, in the illustrated embodiment, the foam material 36 is approximately 0.64 millimeters thick and the fabric layer 38 is approximately 0.36 millimeters thick. When combined with the backing member 32 and the adhesive layer 40, this results in a total thickness of approximately 1.19 millimeters. This combination has proven effective when used with the illustrated printer which has a gap of 1.02 millimeters between the print head 12 and the vacuum belt 16.

The length and width of the absorbent material, as well as the position of the absorbent material on the backing member can also vary greatly depending on the physical configuration of the particular printer for which the media is to be used and the method in which the media is to be used. In general, the absorbent material should be large enough to cover the orifices on the face of the print head and to absorb excess ink. The absorbent material should be positioned such that it comes into contact with the print head when fed through printer's normal print media feed path.

In the embodiment illustrated in FIGS. 2 and 3, the absorbent material 34 is distributed on the backing material in three horizontal strips 34*a*, 34*b*, and 34*c* of approximately equal size. The strips 34*a*, 34*b*, and 34*c* have a width w slightly wider than the print head 12 and length 1 approximately twice as long as the height of the print head. In the illustrated embodiment w is approximately four inches and 1 is approximately one and one half inches. The strips 34*a*, 34*b*, and 34*c* are located approximately one quarter of an inch apart and are generally centered on the backing material.

This particular configuration is preferred for the head tend system employed in the illustrated printer and described below. However, it should be appreciated that in a different printer with a different head tend system it may be desireable to distribute the absorbent material on the backing material in a different configuration. For example, it may be desireable to use one large piece of absorbent material or to use a number of different sized pieces of absorbent material.

The head tend system of the illustrated printer includes a warm up operation and a purge operation. Based on predetermined information regarding the configuration of the head tend media and information received from the sensor 28, the controller 26 controls these operations. The warm up operation, which is represented in block diagram form in FIG. 5, is initiated each time the printer 10 is turned on. Prior to turning the printer on, a head tend media 30 is placed in the tray 24. When the printer 10 is turned on, rollers 20 remove the top media from tray 24 and feed it to the vacuum belt 16. The vacuum belt 16 advances the media until it is detected by the sensor 28. Upon detection the top of form is determined. The carriage 14 then scans across the media to determine the actual left and right edges of the media.

In the illustrated embodiment, the head tend media 30 is provided with identifying marks 42, similar to a bar code, which distinguish the head tend media 30 from print media 22. Detection of these marks 42 by the sensor 28 indicates the presence of the head tend media 30 and the warm up operation continues. If the marks 42 are not detected, the media is ejected from the printer 10 and the controller 26 prompts the operator to load the head tend media 30.

As explained in greater detail below, in addition to the identifying marks 42, the illustrated head tend media 30 is provided with a prior use indicating section 44 which, if blackened, indicates that the media 30 has been previously used for a purge operation. If the sensor 28 detects that the head tend media 30 has been previously used, the media 30 is ejected and the operator is prompted to load an unused head tend media 30.

When the sensor 28 indicates the presence of an unused head tend media 30 within the printer 10, the print head 12 is centered within the top strip of absorbent material 34*a*. This is accomplished by advancing the vacuum belt 16 to move head tend media 30 a predetermined amount beyond the detected top of form and moving the print head 12 a predetermined distance from the detected edge of form. The predetermined distances are based on the known configuration of the head tend media 30 and the known configuration of the print head 12.

Once the print head 12 is centered within the top strip of absorbent material 34*a*, the print head 12 is warmed up. In the illustrated printer 10, this process takes several minutes. During the warm up period the print head remains stationary. Any ink expelled from the print head 12 during the warm up operation is expelled into the top strip of absorbent material 34*a* where it is quickly absorbed away from the print head 12. After the print head 12 has reached operating temperature the vacuum belt 16 is advanced and the head tend media 30 is ejected from the printer 10.

As the head tend media 30 is advanced, the print head 12 is wiped by the bottom half of the top strip 34*a* and the second and third strips 34*b* and 34*c* of absorbent material. In this manner any ink released during the warm up operation is immediately absorbed and removed from the printer and the print head is wiped to remove any accumulated debris or contaminants. Using the illustrated head tend media, it has been found that efficient wiping is accomplished by advancing the media at a rate of approximately one inch per second. However, the use of different materials or a different configuration of the media may require a different wiping speed to obtain optimum results.

Figure 6:
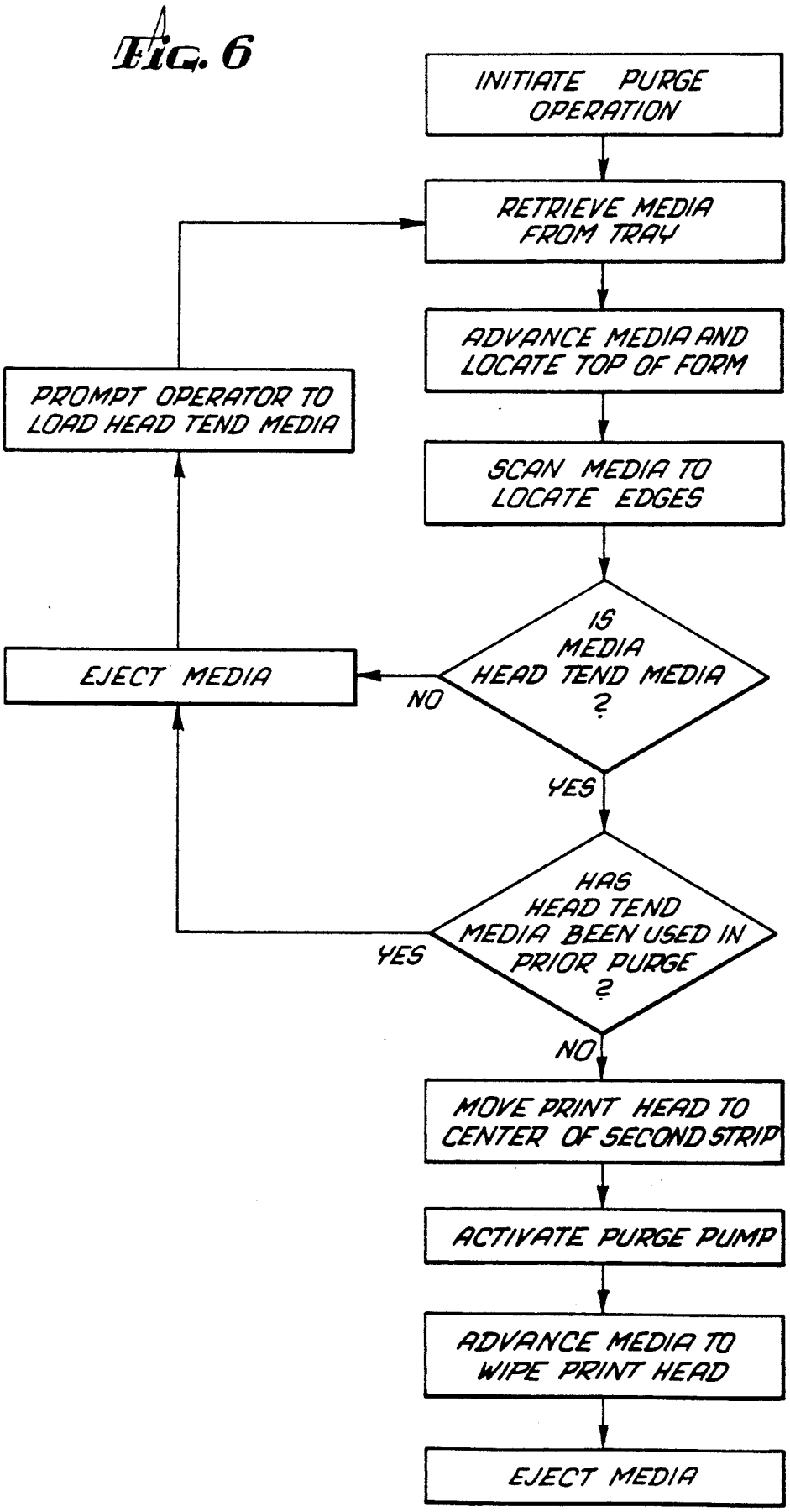
FIG. 6 is a block diagram of a preferred purge operation using the head tend media illustrated in FIGS. 3 and 4.

The purge operation, illustrated in the block diagram of FIG. 6, is typically done immediately following the warm up operation to ensure that the ink supply channels and orifices are properly primed and free of any air bubbles or debris. Additionally, the purge operation may be initiated by the operator at any time. For example, it may be desireable to purge the print head after a certain number of hours of operation or if visual inspection reveals plugged or faulty orifice operation.

When the purge operation is initiated, the next media in the tray 24 is removed by the rollers 20 and fed to the vacuum belt 16. The media is then advanced to detect top of form and the sensor 28 scans the media to detect the actual edge of form. As with the warm up operation, during the scan the sensor 28 verifies that the media is head tend media 30 and that it has not been previously used for a purge operation. Once it has been determined that a clean head tend media 30 is present in the printer 10, the printer 10 blackens the prior use indicating section 44 to prevent use of the same head tend media during subsequent purge operations. The print head 12 is then centered within the second strip of absorbent material 34*b* and the print head 12 is purged.

Figure 7:
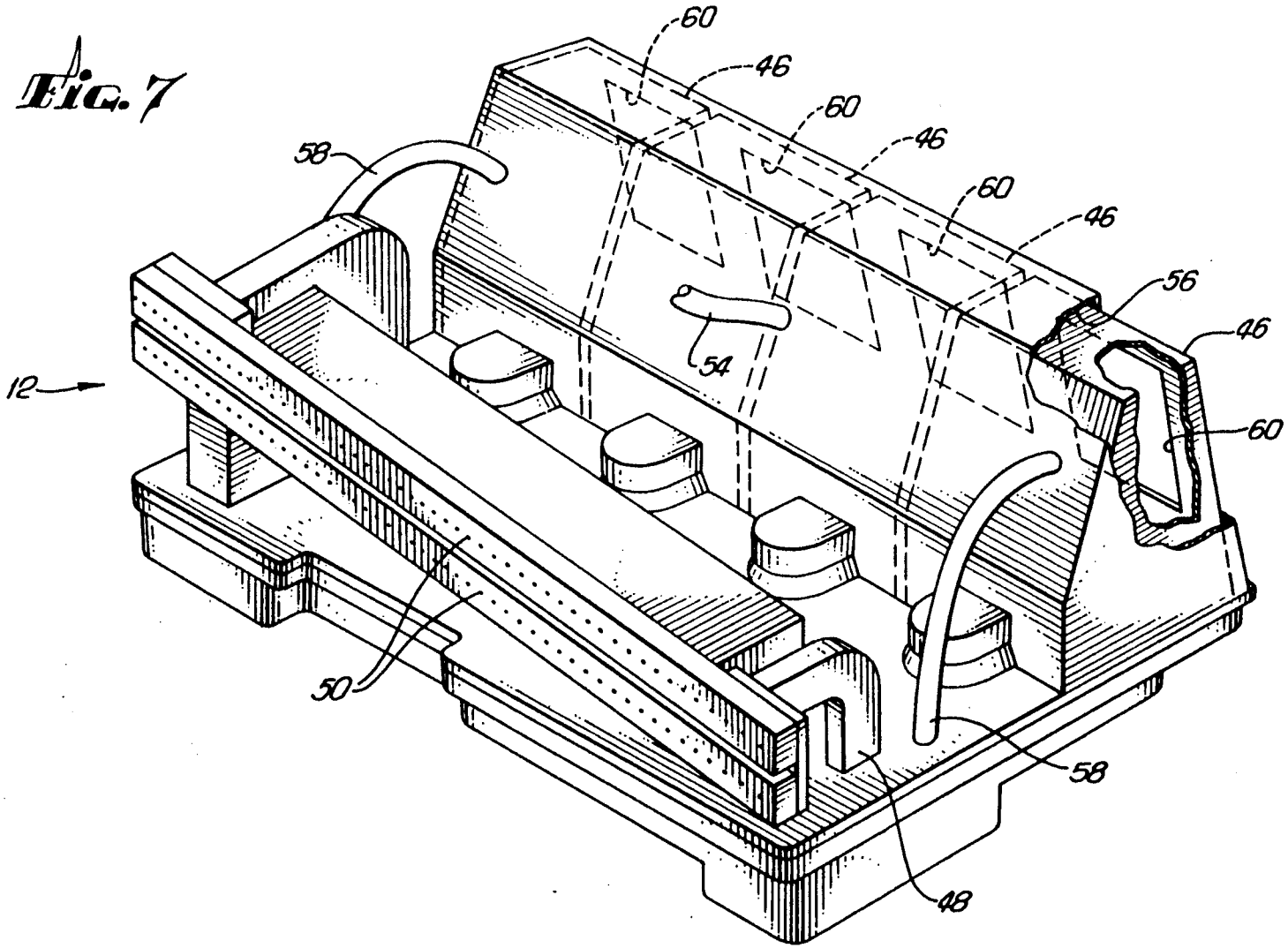
FIG. 7 shows a print head purge mechanism in accordance with a preferred embodiment of the present invention.

During the purge, ink is forced from the ink reservoir 46 (seen in FIG. 7), through the supply channels 48, and expelled out the orifices 50 where it is absorbed by the head tend media 30. The purge may be accomplished in a number of ways. In the printer 10 illustrated in FIG. 1, a purge pump 52 is provided. As best seen in FIGS. 7 and 1, the pump 52 pumps air through a supply line 54 and into a chamber 56 over the ink reservoir 46 within the print head 12. This increases the air pressure within the chamber 56 and forces ink from the reservoir 46 into the supply channels 48 and out the orifices 50.

In the illustrated embodiment, the pump 52 is a standard low flow, low pressure pulsating pump which supplies air at about 1–2 psi. However, the air pressure within the chamber 56 is much lower as a result of air escaping through the overflow lines 58 and the ink loading windows 60. During the purge operation, the pump 52 supplies air to the chamber 46 for approximately seven seconds. In other embodiments it may be desireable to supply the air for a longer or shorter time depending upon the type of pump used, the pressure of the air supplied, and the physical configuration of the print head.

Following the purge operation, the vacuum belt 16 is advanced to eject the head tend media 30 from the printer 10. As the head tend media 30 advances, the print head 12 is wiped by the bottom of absorbent strip **34*b* and the entire absorbent strip 34*c* to remove any excess ink, debris, or contaminants which may be present on the face of the print head 12**. As in the warm up operation, an advance speed of approximately one inch per second had been found to provide satisfactory results.

In some cases it may be desireable to print a confirmation message following the purge operation. In this manner, the operator can inspect the printed message and verify that the purge operation was successful and that the print head is functioning properly. In the illustrated embodiment, this can be accomplished by stopping the advancement of the head tend media following the wiping procedure and printing the control message on the bottom of the backing member 32 prior to ejecting the head tend media 30.

This detailed description is set forth only for purposes of illustrating an example of the present invention. While it is presently believed that this illustration is the best mode of practicing the invention, the detailed description should not be considered to limit the scope of the invention in any way. Clearly numerous additions, substitutions, and other modifications can be made to the invention without departing from the scope of the invention which is defined in the appended claims and equivalents thereof.

We claim:

1. Media for tending a print head in an ink jet printer, said media comprising:

a backing member dimensioned to be fed through the normal print media feed path of the printer; and an absorbent material being dimensioned to be smaller in both width and length than the backing member, said absorbent material attached to the backing member such that the absorbent material is brought into contact with the print head as the media is fed through the normal print media feed path of the printer.

2. The media of claim 1, wherein said absorbent material is in the form of a strip.

3. The media for tending a print head in an ink jet printer, said media comprising:

a backing member dimensioned to be fed through the normal print media feed path of the printer; and an absorbent material being dimensioned to be smaller in both width and length than the backing member, said absorbent material attached to the backing member such that the absorbent material is brought into contact with the print head as the media is fed through the normal print media feed path of the printer, wherein the absorbent material comprises a layer of compressible absorbent foam material and a layer of fabric covering said layer of compressible absorbent foam material.

4. Media for tending a print head in an ink jet printer, said media comprising:

a backing member dimensioned to be fed through the normal print media feed path of the printer; and an absorbent material being dimensioned to be smaller in both width and length than the backing member, said absorbent material attached to the backing member such that the absorbent material is brought into contact with the print head as the media is fed through the normal print media feed path of the printer, wherein said backing member has substantially the same general dimensions as a print media and said absorbent material has a width slightly wider than the print head and length approximately twice as long as the height of the print head.

5. The media of claim 4, wherein there are three strips of absorbent material generally centrally located on said backing member.

6. Media for tending a print head in an ink jet printer, said media comprising;

a backing member dimensioned to be fed through the normal print media feed path of the printer, said backing material including identification means for allowing the printer to identify the media; and an absorbent material comprising a layer of compressible absorbent material covered by a layer of fabric, said absorbent material being attached to the backing member such that the absorbent material is brought into contact with the print head as the media is fed through the printer.

7. The media of claim 6 wherein the identification means comprises marks on the backing media which can be detected by a top of form sensor provided in the printer.

8. A head tend media for use in an ink jet printer during the warm up cycle in which the head is raised to operating temperature and the purge cycle in which ink is purged from the head, said tend media comprising:

a backing member dimensioned to be fed through the normal print media feed path of the printer; and at least one cleaning strip being dimensioned to be smaller in both width and length than the backing member, said cleaning strip being attached to the backing member, said strip being made of ink absorbing material and positioned on the backing member such that the cleaning strip comes into contact with the print head when the head tend media is advanced through the normal print media feed path.

9. The head tend media of claim 8 wherein there are three cleaning strips.

10. A head tend media for use in an ink jet printer during the warm up cycle in which the head is raised to operating temperature and the purge cycle in which ink is purged from the head, said head tend media comprising:

a backing member dimensioned to be fed through the normal print media feed path of the printer;

at least one cleaning strip attached to the backing member, said strip being made of ink absorbing material and positioned on the backing member such that the cleaning strip comes into contact with the print head when the head tend media is advanced through the media feed path; and identification marks detectable by the printer's top of form sensor to identify the media as a head tend media.

11. A head tend media for use in an ink jet printer during the warm up cycle in which the head is raised to operating temperature and the purge cycle in which ink is purged from the head, said head tend media comprising:

a backing member dimensioned to be fed through the normal print media feed path of the printer;

at least one cleaning strip attached to the backing member, said strip being made of ink absorbing material and positioned on the backing member such that the cleaning strip comes into contact with the print head when the head tend media is advanced through the media feed path;

identification marks detectable by the printers top of form sensor to identify the media as a head tend media; and means for allowing the printer to determine whether the media has been previously used.

12. The head tend media of claim 11, wherein said means comprises a printed marking formed by the ink jet printer on the media to indicate that the head tend media has been previously used.

13. A method of tending a head in an ink jet printer comprising the steps of:

providing a head tend media having at least one section of absorbent material attached to a backing member, said head tend media being dimensioned to be fed through the normal feed path of the printer, said absorbent material being dimensioned to be smaller both in width and length than said backing member; and loading said head tend media using the normal paper advance mechanism of the printer to bring the absorbent material into contact with the head and to wipe the head with the absorbent material.

14. In an ink jet printer having a head, a top of form sensor, and a form feed mechanism for advancing print media through the printer, a method of tending the head comprising the steps of:

providing a head tend media, said head tend media having at least one portion of absorbent material attached to a backing member and being dimensioned to be advanced through the printer by the form feed mechanism, said absorbent material positioned such that it is brought into contact with the print head as the media is advanced through the printer, said head tend media provided with an identifying marks detectable by the top of form sensor for identifying the media as head tend media and a use indicating means indicating that the media has been previously used;

loading the head tend media into the form feed mechanism;

advancing the media through the printer until the absorbent material is in contact with the head;

performing a head tend operation;

advancing the head tend media to wipe the print head with the absorbent material; and ejecting the media.

15. The method of claim 14, wherein said head tend media has a top strip of absorbent material, a middle strip of absorbent material and a bottom strip of absorbent material, and wherein said step of advancing the media through the printer until the absorbent materials is in contact with the head includes the steps of:

centering the head within the top strip of absorbent material; and warming up the head.

16. The method of claim 15, wherein said step of advancing the head tend media to wipe the print head includes the step of wiping the head tend media by said top strip, said middle strip and said bottom strip.

17. The method of claim 15, wherein said step of advancing the media through the printer until the absorbent materials is in contact with the head includes the step of centering the head within the middle strip of absorbent material for purging the head.

18. The method of claim 15 further comprising the step of distinguishing the head tend media from print media.

19. The method of claim 15 further comprising the step of determining whether the head tend media has been previously used.

20. The method of claim 19 further comprising the step of ejecting the media when it is determined that the tend media has been previously used.

21. The method of claim 15 further comprising the step of marking the head tend media by the head after the media has been used.

22. An ink jet printer for use with print media and print head tend media, comprising:

an ink jet head;

form feed means for advancing a media through the ink jet printer;

top of form sensor means for determining edges of the media;

form identifying means for determining whether the media is a print media or a print head tend media;

prior use determination mans for determining whether the print head tend media has previously been used;

advancing means for advancing the head tend media to locate the head tend media at the ink jet head and moving the print head relative to the head tend media to allow the head tend media to wipe the ink jet head; and ejecting means for ejecting the head tend media from the printer.

23. The ink jet printer of claim 22 further comprising heater means coupled to the ink jet head for heating the ink jet head.

24. The ink jet printer of claim 22 further comprising purge means for purging the print head when the print head tend media is advanced to the ink jet head.

* * * * *